US007293405B2

(12) United States Patent
Kemmner et al.

(10) Patent No.: US 7,293,405 B2
(45) Date of Patent: Nov. 13, 2007

(54) MULTI-CYLINDER INTERNAL COMBUSTION ENGINE AND METHOD FOR OPERATION THEREOF

(75) Inventors: Markus Kemmner, Unterensingen (DE); Thomas Koch, Boeblingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/579,073

(22) PCT Filed: Jul. 9, 2004

(86) PCT No.: PCT/EP2004/007563

§ 371 (c)(1),
(2), (4) Date: Jan. 5, 2007

(87) PCT Pub. No.: WO2005/052329

PCT Pub. Date: Jun. 9, 2005

(65) Prior Publication Data

US 2007/0221166 A1 Sep. 27, 2007

(30) Foreign Application Priority Data

Nov. 11, 2003 (DE) ..... 103 52 498

(51) Int. Cl.
*F01N 3/023* (2006.01)

(52) U.S. Cl. ..... 60/284; 123/321; 123/90.15; 60/300; 60/320

(58) Field of Classification Search .. 123/90.15–90.18, 123/321, 322; 60/284, 300, 320
See application file for complete search history.

(56) References Cited

U.S. PATENT DOCUMENTS 5,398,502 A * 3/1995 Watanabe ..... 60/284
6,494,173 B2 * 12/2002 Takahashi et al. ..... 123/90.15

(Continued)

FOREIGN PATENT DOCUMENTS

CH 310325 12/1955

(Continued)

OTHER PUBLICATIONS

International Search Report.

*Primary Examiner*—Erick Solis
(74) *Attorney, Agent, or Firm*—Crowell & Moring LLP

(57) ABSTRACT

In a multi-cylinder internal combustion engine and a method for operating a multi-cylinder internal combustion engine, cylinders are assigned an exhaust line and, in each case, a gas inlet valve and a gas outlet valve which are used for the charge cycle. At least one of the cylinders of the internal combustion engine has an additional outlet valve through which, in the opened state, a flow connection can be established between the combustion chamber and the exhaust line. At least one of an exhaust gas composition and an exhaust gas temperature is changed compared to the normal operating mode, and regeneration of the exhaust gas cleaning unit can be set in conjunction with a regeneration operating mode for regenerating an exhaust gas cleaning unit which is arranged in the exhaust line by activating the additional outlet valve of at least one cylinder. For the method, the additional outlet valve of at least one cylinder is opened at least temporarily in conjunction with regeneration of the exhaust gas cleaning unit.

21 Claims, 1 Drawing Sheet

U.S. PATENT DOCUMENTS

| | | | | |
|---|---|---|---|---|
| 6,823,661 | B2 * | 11/2004 | Minami | 60/285 |
| 6,826,905 | B2 * | 12/2004 | Gui et al. | 60/295 |
| 7,156,072 | B2 * | 1/2007 | Song et al. | 123/321 |
| 2004/0216449 | A1 * | 11/2004 | Szymkowicz et al. | 60/284 |

FOREIGN PATENT DOCUMENTS

| | | | |
|---|---|---|---|
| EP | 1 260 684 | A2 | 11/2002 |
| EP | 1 304 458 | A1 | 4/2003 |

* cited by examiner

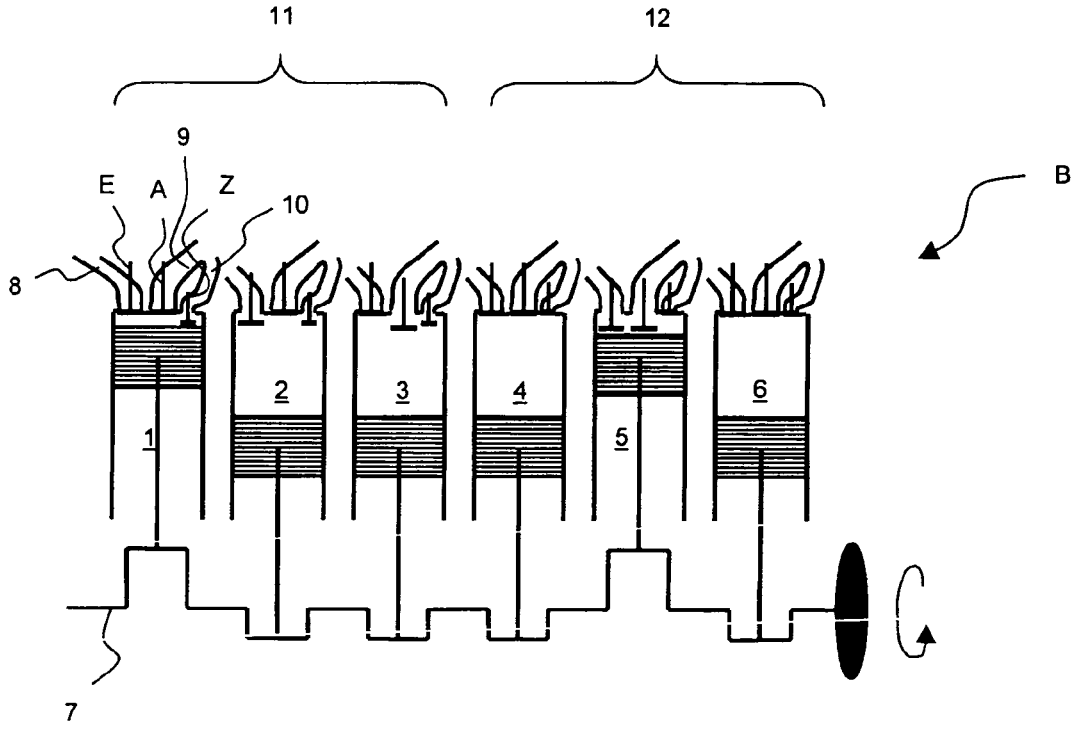
Fig.

MULTI-CYLINDER INTERNAL COMBUSTION ENGINE AND METHOD FOR OPERATION THEREOF

BACKGROUND AND SUMMARY OF THE INVENTION

This invention relates to a multi-cylinder internal combustion engine and, in addition, to a method for operating a multi-cylinder internal combustion engine.

Swiss patent CH 310325 discloses a method for operating an internal combustion engine having valves which are used for the charge cycle, in which method a flow connection is established—by opening an additionally provided additional valve—between the combustion chamber of an internal combustion engine and an exhaust line which is assigned to the internal combustion engine. The additional valve is continuously opened in the braking mode of the internal combustion engine, producing a braking effect. This increases the braking work which is applied when the associated motor vehicle is braked.

The object of the invention is, in contrast with the above, to provide an internal combustion engine and a method for operating an internal combustion engine with which regeneration of an exhaust gas cleaning unit which is assigned to the internal combustion engine can be promoted effectively and efficiently when necessary. This object is achieved by an internal combustion engine and by a method as claimed.

At least one of the cylinders of the internal combustion engine according to the invention has, in addition to the usual inlet and outlet valves which are used for the charge cycle, an additional outlet valve through which, in the opened state, a flow connection is established between the combustion chamber and the exhaust line. In addition, an exhaust gas cleaning unit is arranged in the exhaust line which is assigned to the cylinders of the internal combustion engine. An exhaust gas composition and/or exhaust gas temperature which are changed compared to the normal operating mode and promote the regeneration of the exhaust gas cleaning unit can be set in conjunction with a regeneration operating mode for regenerating the exhaust gas cleaning unit by activating the additional outlet valve of at least one cylinder.

Preferably a particle filter and/or a catalytic converter such as, for example, a nitrogen oxide accumulator-type catalytic converter are provided as an exhaust gas cleaning unit. In addition, it is of course possible for further components which are used for cleaning the exhaust gas to be arranged in the exhaust line. In particular for regenerating such an exhaust gas cleaning unit it is advantageous if the latter is supplied with an exhaust gas at a raised temperature and/or with a composition which is changed compared to the normal operating mode, for example with an increased content of reducing components.

Customary measures for this comprise intake-end or exhaust-gas-end throttling, combustion-end measures such as changing the fuel injection point or feeding fuel or secondary air into the exhaust section upstream of the corresponding exhaust gas cleaning unit. These measures are usually associated with a high degree of expenditure on equipment or have other disadvantages.

Consequently, the setting of the aforesaid exhaust gas properties which bring about or promote regeneration is carried out by activating, i.e. by at least temporarily opening the additional outlet valve of at least one cylinder of the internal combustion engine. Since a connection is established between the combustion chamber and the exhaust line by the opened additional outlet valve, it becomes possible for the exhaust gas conditions to be influenced in the aforementioned way by means of the respective conditions in the combustion chamber of the cylinder, and for regeneration of an exhaust gas cleaning unit to be promoted. This applies both to over-run conditions with power drain and to a traction mode with power being output by the internal combustion engine.

In particular in internal combustion engines which from the outset already have a cylinder with an additional outlet valve, for example what is referred to as a decompression valve, in order to use the internal combustion engine as a vehicle brake, the additional expenditure on equipment and the effort involved in application are low. In addition, the worsening of the efficiency of the internal combustion engine when the additional outlet valve is activated can generally be kept small so that there is only a small additional consumption of fuel.

The internal combustion engine according to the invention may have just a single cylinder with an additional outlet valve. However, typically a plurality of cylinders, in particular all the cylinders, of the internal combustion engine have an additional valve.

In a refinement of the invention, when the additional outlet valve is activated at least one cylinder can be operated with a fuel supply which is reduced compared to the operating mode without activation of the additional outlet valve. At a specific operating point, in particular at an operating point at which there is provision for the exhaust gas cleaning unit to be regenerated, it thus becomes possible at the same time to activate the additional outlet valve at least one cylinder as well as operate with a reduced fuel supply compared to the fuel supply which is normally provided at this operating point. In order to set the fuel supply to the cylinders, an injection system which permits cylinder-selective actuation is preferably provided. Said system may be a common rail system, a system according to the pump-nozzle principle or some other system with injectors which can preferably be actuated individually. The change in the fuel supply also includes their complete shutdown. The exhaust gas temperature and/or the exhaust gas composition can be influenced particularly precisely and sensitively with this refinement of the invention.

In a further refinement of the invention, when there is at least one cylinder with an additional outlet valve the additional outlet valve can be activated in a clocked fashion such that when there are a multiplicity of working cycles the additional outlet valve is opened in each case in the region of the top dead center in the compression stroke and is otherwise closed. For this embodiment there is preferably provision for the drive of the additional outlet valve to be constructed in such a way that it is decoupled from the drive for the normal charge cycle valves of the internal combustion engine. For example a separate electromagnetic drive is advantageous for the additional valves. The additional valves are preferably to be opened approximately in the region of 90° crank angle before the top dead center to 90° after the top dead center. When an additional outlet valve opens before the top dead center, it becomes possible for unburnt fuel to pass over into the exhaust section. Opening after the top dead center mainly results in an increase in the exhaust gas temperature.

In a further refinement of the invention, a cylinder group which is formed from at least two preferably adjacent cylinders with an additional outlet valve is provided. The cylinder group is preferably selected in such a way that fluctuations in the torque or in the synchronous running are minimized when the additional outlet valves are activated. For example, in a six-cylinder series-mounted engine it is possible to provide an additional outlet valve only at the first and second cylinders. In the same way it is possible in an internal combustion engine which is embodied as a V-mounted engine to provide additional outlet valves only at the cylinders of one cylinder bank. This keeps the structural complexity correspondingly low.

In a further refinement of the invention, when there are at least two preferably adjacent cylinders with an additional outlet valve there is provision for the additional outlet valve to be activated. For example in an internal combustion engine with a plurality of cylinders with an additional outlet valve it is advantageous to activate the additional outlet valves in a chronologically alternating fashion at, in each case, two adjacent cylinders in conjunction with a regeneration operating mode. This keeps in particular the thermal loading on the respective cylinders low. If all the cylinders of a six-cylinder internal combustion engine are provided with an additional outlet valve, it is possible, for example, to activate the additional outlet valve alternately at cylinder 1 and 2, cylinder 3 and 4 and cylinder 5 and 6.

In a further refinement of the invention, at least two cylinders are provided with an additional outlet valve and the number of cylinders at which the additional outlet valve is activated can be set in a variable fashion, in particular as a function of the exhaust gas temperature. This embodiment is particularly advantageous if all the cylinders of the internal combustion engine have an additional outlet valve. Depending on the thermal demand of the exhaust gas cleaning unit, when there are two or more adjacent cylinders the additional outlet valves can preferably be activated in synchronism or in each case in phase with the position of the piston of the respective cylinder. In this way it is possible in particular to set the input of heat into the exhaust gas cleaning unit very precisely and in accordance with the demand.

In a further refinement of the invention, when there is at least one cylinder with an additional outlet valve, operation with a closed additional outlet valve and with a fuel supply which is reduced compared to the normal operating mode becomes possible. As a result, in addition to influencing the exhaust gas temperature and/or exhaust gas composition in the special operating mode of regeneration of the exhaust gas cleaning unit, it is additionally possible to influence the power output in the normal operating mode of the internal combustion engine. When the fuel supply is reduced to zero, over-run shut-off is made possible under over-run conditions. It is particularly advantageous that regeneration of the exhaust gas cleaning unit also becomes possible in this operating mode, or can be continued, since an additional outlet valve can also be provided at one or more further cylinders, and these cylinders can be operated with the additional outlet valve activated. In this way, the input of heat into the exhaust gas cleaning unit is maintained. The cylinders with an activated additional outlet valve can be operated with a reduced fuel supply here if appropriate.

In a further refinement of the invention, the regeneration operating mode can be set when the additional outlet valve of at least one cylinder is activated in an operating range with reduced power output by the internal combustion engine. In particular in an internal combustion engine which operates according to the diesel principle, the input of heat into the associated exhaust gas cleaning unit is frequently low in the lower partial load range so that said unit does not always reach its appropriate temperature or drops below it. In order to reach the desired temperature of the exhaust gas cleaning unit, there is therefore provision for one or more of the additional outlet valves to be activated below a predefinable load point in the partial load range of the internal combustion engine. Above the predefinable load point of the internal combustion engine, the additional valve remains closed in the traction mode of the internal combustion engine. This additionally ensures that the additional valve or components which conduct exhaust gas are not overheated. In order to regulate the input of heat into the exhaust gas cleaning unit in the partial load range it is additionally possible to provide for the opening width of the additional outlet valve to be set as a function of the load point of the internal combustion engine. A characteristic diagram or a characteristic diagram region is assigned to the corresponding load range, there being preferably provision for the regeneration of an exhaust gas cleaning unit to be promoted in the load range with less than 50% rated power by activating an additional outlet valve.

In a further refinement of the invention, it becomes possible for the charge pressure to be influenced in conjunction with a regeneration operating mode for the internal combustion engine having an exhaust gas turbocharger. In particular there is provision, in conjunction with the regeneration operating mode, to provide for the charge pressure to be lowered. As a result of the increase in the exhaust gas temperature when an additional outlet valve is activated, an increased power output by the turbocharger can occur. This can be counteracted by means of the measure according to the invention for reducing the charge pressure. For this purpose it is advantageous if the exhaust gas turbocharger is embodied in such a way that its rotational speed can be influenced. However, the reduction of the charge pressure also permits the exhaust gas temperature to be influenced directly and is preferably provided as a increasing the temperature. It is advantageous if the corresponding settings are made possible as a function of the temperature of the exhaust gas cleaning unit.

In a further refinement of the invention, it becomes possible for the quantity of recirculated exhaust gas to be influenced in conjunction with a regeneration operating mode for the internal combustion engine having an adjustable exhaust gas recirculation device. For this purpose, an adjustable exhaust gas recirculation valve is preferably provided in the exhaust gas recirculation system. This measure makes it possible to influence effectively the exhaust gas temperature and/or the exhaust gas composition by means of the quantity of recirculated exhaust gas.

In a further refinement of the invention, the regeneration operating mode is provided when the vehicle is stationary. This measure prevents the driving mode being disrupted by the regeneration of the exhaust gas cleaning unit. The measure can additionally be provided as an emergency regeneration if an increased regeneration demand, preferably in the form of an increased degree of blocking of a filter is detected. An increased rotational speed of the internal combustion engine is preferably set when the vehicle is stationary. In this way, the conditions which are necessary for regeneration of the exhaust gas cleaning unit can also be set when the vehicle is stationary.

For the method according to the invention there is provision that, the additional outlet valve of at least one cylinder is opened at least temporarily in conjunction with a regeneration operating mode for regenerating an exhaust gas cleaning unit which is arranged in the exhaust line.

In addition to the activation of the additional valve according to the invention in order to promote the regeneration of the corresponding exhaust gas cleaning unit, the additional valve can, of course, continue to be activated or opened in order to boost the braking effect in the braking mode.

When one cylinder is provided with an additional outlet valve, it is possible to provide that when the additional outlet valve is activated said valve is operated in a fired fashion or even in an unfired fashion. In the former case, the internal combustion engine is preferably in the traction mode with a positive power output to the drive unit, and in the case mentioned second the internal combustion engine is preferably in the braking mode or under over-run conditions. In both cases it is possible to provide for the additional outlet valve of one cylinder, or if appropriate of a plurality of cylinders, to be kept at least partially in an opened state.

In one refinement of the method, at least one cylinder is operated with an at least temporarily opened additional outlet valve and with a fuel supply which is reduced compared to the normal operating mode. In this context, the reduction of the fuel supply can also include shutting it down completely. Normal operating mode is understood here to be the corresponding operating point of the internal combustion engine at which the corresponding additional outlet valve remains unactivated, i.e. continuously closed. It is basically advantageous to provide for the optional reduction in the fuel supply at all the cylinders, irrespective of whether or not they have an additional output valve.

The power output or power drain of the cylinder and thus the intensity of the heat which is output to the exhaust gas via the opened additional outlet valve can be set very effectively and adapted to the thermal demand of the exhaust gas cleaning unit by reducing the fuel supply. When there is a very large reduction in the fuel supply, combustion no longer occurs in the cylinder and the cylinder is operated in an unfired state. If the fuel supply is not shut down completely, in this case unburnt fuel is fed into the exhaust gas through the opened additional outlet valve and the exhaust gas is thus enriched with reducing agents. In this way it is possible, for example, to promote reductive regeneration of an exhaust gas cleaning unit or heat can be released in the exhaust section by post-combustion of the unburnt fuel.

In a further refinement of the method, there is provision for the additional outlet valve of at least one cylinder to be kept open in the region of the top dead center in the compression stroke, and otherwise kept closed, during a multiplicity of working cycles of the cylinder.

In this operating mode, the corresponding cylinder is operated in a braked fashion since previously compressed gases from the cylinder escape into the exhaust line without carrying out expansion work. When the cylinder is fired, these gases are very hot and the exhaust gas is correspondingly heated up to a high degree. If the fuel supply to the respective cylinder is reduced or shut off, the input of heat into the exhaust gas is correspondingly lower.

In a further refinement of the method, the additional outlet valve of at least one cylinder is kept continuously open during a multiplicity of working cycles of the cylinder. In this operating mode also, the corresponding cylinder is operated in a braked fashion even if the braking effect and the input of heat into the exhaust gas are reduced. However, the expenditure in terms of control is also lower.

In a further refinement of the method, at least one cylinder of the internal combustion engine, in particular a cylinder with an additional outlet valve, is operated with a reduced fuel supply. In this context at a cylinder with an additional outlet valve said valve can be kept temporarily opened or temporarily closed. The reduction in the fuel supply can also comprise shutting it down completely here. In this way it is possible in particular to carry out fine adjustment of the regeneration conditions. It is possible to set both the exhaust gas temperature and the exhaust gas composition, in particular the oxygen content of the exhaust gas. At the same time, the power output can be finely set, as a result of which fluctuations in the torque can be avoided.

In a further refinement of the method, at least two preferably adjacent cylinders are provided with an additional outlet valve and their additional outlet valves are activated synchronously. By grouping cylinders with respectively synchronously operated additional outlet valves it is possible to avoid, or minimize, degradation of the smooth running, and actuation is also made easier.

In a further refinement of the method, in an internal combustion engine with at least two cylinders with an additional outlet valve the number of cylinders with an at least temporarily opened additional outlet valve is set as a function of the load of the internal combustion engine. In this way it is possible to influence the exhaust gas properties very effectively. As the load or rotational speed of the internal combustion engine decreases, an increasing number of cylinders is preferably operated with an at least temporarily opened additional outlet valve. The number of corresponding cylinders may be predefined here by regions of characteristic diagrams.

In a further refinement of the method for operating an internal combustion engine having an exhaust gas turbocharger, a reduced charge pressure is set in conjunction with the regeneration operating mode. In this way it is possible in particular to influence additionally the exhaust gas temperature. The reduction in the charge pressure is preferably brought about by reducing the rotational speed by means of a blade adjustment or a waste gate adjustment of the corresponding exhaust gas turbocharger.

In a further refinement of the method for operating an internal combustion engine having an adjustable exhaust gas recirculation device, an increased quantity of recirculated exhaust gas is set in conjunction with the regeneration operating mode. This measure is expedient in particular for fine adjustment of the regeneration conditions and is preferably used in conjunction with other measures for influencing the exhaust gas temperature and/or the exhaust gas composition.

In a further refinement of the method, the regeneration operating mode is carried out when the vehicle is stationary. This can be done during an interruption of the normal driving mode or as part of a visit to a workshop. These measures permit, for example, excessively long regenerations to be carried out which cannot be carried out during the normal driving mode owing to changing operating conditions.

Advantageous embodiments of the invention are illustrated in the drawing and will be described below.

BRIEF DESCRIPTION OF THE DRAWINGS

The single drawing FIGURE is a schematic view of an internal combustion engine with six cylinders mounted in series.

DETAILED DESCRIPTION OF THE INVENTION

The single FIGURE provides a schematic view of an internal combustion engine B which is embodied as a series-mounted engine with six cylinders 1 to 6. The cylinders each have a combustion chamber (not designated separately), and an inlet valve E and outlet valve A which are used for the charge cycle, as well as in addition an additional outlet valve Z. In the case illustrated, all the cylinders 1 to 6 of the internal combustion engine B each have an additional outlet valve Z, and the cylinders 1 to 3 form a first cylinder group 11, and the cylinders 4 to 6 form a second cylinder group 12. The cylinders of the cylinder groups 11, 12 are preferably each operated synchronously or in the same way. It is, however, of course possible also to provide for just a single cylinder or only a number of the cylinders 1 to 6 to have an additional outlet valve Z, and for the cylinders 1 to 6 to be operated in different ways, for example with respect to the fuel supply or the activation of the additional outlet valve Z.

In the case illustrated, the cylinders of the cylinder groups 11, 12 are assigned a common crankshaft 7 for transmitting the torque. The cylinders of the internal combustion engine B are preferably embodied in the same way, for which reason the components assigned to a respective cylinder are provided with reference symbols only at the cylinder 1.

The internal combustion engine B is embodied here as a 4-stroke engine which operates according to the diesel principle.

Correspondingly, the cylinders 1 to 6 receive their combustion air via an air inlet port 8 and in the normal operating mode they output the exhaust gases from the combustion via an air outlet port 9, an exhaust line and an exhaust gas cleaning unit (each not illustrated) into the surroundings. In the opened state of the additional outlet valve Z, a flow connection is present between the combustion chamber of the respective cylinder and the exhaust line via the additional outlet port 10. In particular when the piston moves upwards, exhaust gas therefore passes out of the corresponding combustion chamber into the exhaust line when the additional outlet valve Z is opened. Consequently, the properties of the exhaust gas can be influenced by means of the opened additional outlet valve Z.

The inlet valves E and the outlet valves A can preferably each be jointly actuated in a mechanical fashion by means of a camshaft, while the additional outlet valves Z each have a separate, preferably electromagnetic actuation means. In particular there is provision for the additional outlet valves Z to be capable of being activated individually in such a way that during one working cycle they can be opened in a clocked fashion for a freely selectable time period. This time period may constitute a fraction of the working cycle or a longer time period over a multiplicity of working cycles. This provides a wide room for maneuver in terms of variation for influencing the properties of the exhaust gas.

The cylinders 1 to 6 of the internal combustion engine B can, of course, each have more than a single inlet valve E and a single outlet valve A. In addition, the cylinders 1 to 6 of the internal combustion engine B can, of course, also be combined in the manner of a V-mounted engine or in some other way to form groups. The cylinder groups can, of course, each be assigned a separate exhaust section with one exhaust gas cleaning unit each.

Although, for reasons of clarity, it has not been illustrated here in more detail, it goes without saying that the internal combustion engine B is also assigned a preferably electronically controllable injection system with, in each case, a fuel injection valve for each of the cylinders 1 to 6. The injection system is preferably embodied in such a way that multiple injections with injection quantities and injection times which are freely selectable in the scope of what is technically feasible on a cylinder-selective basis become possible. In addition, the internal combustion engine B has an exhaust gas turbocharger and an exhaust gas recirculation device (also not illustrated here). In order to control the aforesaid components and the entire operation of the internal combustion engine B and to sense the relevant operating variables, an electronic engine controller (also not illustrated) is provided.

Depending on the time at which the additional outlet valve Z of a respective cylinder is activated or opened, and the period of time for which this occurs, different effects can be achieved. Thus, in addition to the braking effect mentioned at the beginning, the temperature of the exhaust gases which flow out of the respective cylinder can be increased compared to a normal operating mode without activating the additional outlet valve Z. This is the case in particular if the additional outlet valve Z is opened in the region of the top dead center in the compression stroke. Furthermore, the exhaust line can be supplied with an exhaust gas which contains unburnt components. This can be achieved, for example, by opening the additional outlet valve Z in the compression stroke or before the normal combustion in the respective cylinder is finished. For example, it is possible to provide for a preinjected quantity of fuel to be conducted at least partially into the exhaust line by opening the additional outlet valve Z during the compression stroke, as a result of which an exhaust gas which is enriched with unburnt fuel components can be supplied to the exhaust gas cleaning unit. Said components can be oxidized at an oxidation catalytic converter, assigned to the exhaust gas cleaning unit, while releasing heat in the process, which also increases the temperature of the exhaust gas which is supplied to the exhaust gas cleaning unit. In the case of an exhaust gas cleaning unit which is embodied as a particle filter, its temperature can be raised in this way and the regeneration can thus be promoted by burning off soot. The change in the exhaust gas temperature of exhaust gas composition which is brought about by activating the additional outlet valve Z can, however, also allow further and/or different exhaust gas cleaning units such as, for example, a Denox catalytic converter, to be regenerated or operated.

Heating, for example, an oxidation catalytic converter in the exhaust section within the scope of a regeneration process can also be brought about by performing late injection of fuel at one or more cylinders. This is preferably performed at the start of injection at approximately 15° to 25° crank angle after the top dead center. In this context, unburnt or partially burnt fuel components are introduced into the exhaust gas through the opened outlet valves or into the exhaust gas through the opened additional outlet valve and then experience post-combustion in the oxidation catalytic converter while releasing heat in the process. In this context it is also possible to provide for the main injection of fuel to be dispensed with at the cylinder or cylinders so that the cylinder or cylinders do not emit any mechanical energy, that is to say are dragged. In this case, combustion of the post-injected fuel does not occur since, owing to the absence of a main injection, only a slight increase in pressure and temperature occurs in the compression stroke. The post-injected fuel is instead introduced into the exhaust section after having been conditioned as fuel vapor, and therefore in a particularly homogeneous fashion. Furthermore, the respective additional outlet valve Z is loaded thermally only to a small degree in this case.

In order to explain preferred modes of operation, it is assumed below that a regeneration demand has been detected in the form of the burning off of soot for a particle filter. This is preferably done by evaluating the signals of diagnostic means (not illustrated in more detail) by means of the electronic engine controller. Said means determine the current operating state and in particular the current temperature of the exhaust gas or of the particle filter by means of sensors which are suitable for this purpose, and initiate the measures to be taken as a function of these values. If, for example, by evaluating characteristic diagrams it is detected that only a comparatively small increase in the temperature of the exhaust gas or particle filter to a value which is necessary for the burning off of soot is required, the following mode of operation of the internal combustion engine is preferably set by the engine controller.

The fuel supply to the cylinders 1 to 3 of the first cylinder group 11 is shut off, or remains shut off, and the additional outlet valves Z of the cylinders 1 to 3 are opened entirely, as illustrated in the FIGURE. Owing to the opened additional outlet valves Z, these cylinders are braked, but are operated in an unfired state owing to the lack of a fuel supply. In this context, the inlet valves E and the outlet valves A are actuated without modification by means of the camshaft and operated in a normal way. If necessary, the torque which is to be set in accordance with the current driving situation is adapted by adjusting the fuel supply to these cylinders 4 to 6 of the second cylinder group 12. These continue to be operated in a fired state with a continuously closed additional outlet valve Z.

The cylinders 1 to 3 carry out compression work in the compression strokes, as a result of which the air which is supplied to these cylinders via the inlet valves E is correspondingly heated. Owing to the continuously opened additional outlet valves Z of the cylinders 1 to 3, gas which is heated to a higher extent compared to the normal operating mode passes into the exhaust line, and the particle filter is heated as a result. It is advantageous if the opening width of the additional outlet valves Z can be adjusted. By adjusting the opening width as a function of the temperature of the exhaust gas or particle filter it is possible to effectively adjust the input of heat into the particle filter through the opened additional outlet valves Z.

If the engine controller determines that this heating measure is not sufficient to heat the particle filter to the temperature for burning off soot, which may mainly be the case in an operating state in the lower partial load range, the following measures can alternatively be taken on an individual basis or in combination.

A firstly preferred measure consists in supplying the cylinders 1 to 3 of the first cylinder group 11 with a small quantity of fuel which is reduced compared to the normal operating mode. Said quantity can be selected such that no ignition takes place in the combustion chambers of these cylinders. For this reason, unburnt fuel passes into the exhaust line and is catalytically oxidized at an oxidation catalytic converter which is arranged upstream of the particle filter. This catalytically promoted post-combustion causes the exhaust gas temperature to rise, thus increasing the input of heat into the particle filter.

As a further measure it is possible to provide for the cylinders 1 to 3 of the first cylinder group 11 to be supplied with a quantity of fuel which is suitable for normal combustion, and for the additional outlet valves Z to be operated in a clocked fashion at the same time. The clocking is preferably carried out in such a way that the additional outlet valves Z are opened only approximately in the range from 90° in front of the top dead center in the compression stroke to approximately 90° after the top dead center. The opening preferably occurs in the region 30° before the top dead center to approximately 90° after the top dead center, and is particularly preferably in the region 30° before the top dead center to approximately 60° after the top dead center. The corresponding cylinders are thus operated in a fired but braked state. In this mode of operation, hot combustion gases escape into the exhaust line via the opened additional outlet valves Z and additional outlet ports 10 during the compression stroke. The hot combustion gases carry thermal energy into the exhaust gas cleaning unit, as a result of which said unit is heated or is prevented from cooling. Furthermore, it is also possible to provide an intermittent operating mode of the additional outlet valves Z in which said valves Z are not opened or activated at each working cycle but rather merely at each predefinable multiple of a working cycle. Furthermore it is possible to provide for the number of cylinders which are operated in such a fashion to be adjusted preferably as a function of the temperature of the exhaust gas or particle filter or the load range of the internal combustion engine B. In this context all the cylinders of the internal combustion engine B can also be operated in this way when there is an increased heat demand. For fine adjustment of the temperature it is preferably also possible to provide for one, or if appropriate more cylinders to be operated with a continuously closed additional outlet valve Z, but with a reduced or entirely shut down fuel supply.

The aforesaid measures and operating variants of an internal combustion engine B with activation of an additional outlet valve Z of a cylinder 1 to 6 prove advantageous particularly in the partial load range since in this range the exhaust gas is at a comparatively low temperature without additional measures and regeneration with increased thermal demand thus does not become possible. The measures can however also be advantageously applied if the internal combustion engine B is operated at or near to the full load. In order to avoid thermal overloading it is possible to provide here for the additional outlet valve to be activated at just one cylinder or at a few cylinders. In this context these cylinders can, if appropriate, be operated, or respectively dragged, with a reduced or entirely shut down fuel supply. The remaining cylinders are then operated at high load with a continuously closed additional outlet valve in order to maintain the power of the internal combustion engine.

As an additional measure it is possible to provide for suitable measures for changing the rotational speed, in particular for lowering the rotational speed of the exhaust gas turbocharger, to be taken. Different measures are possible depending on the design of the turbocharger. With a turbocharger with a variable turbine geometry (VTG charger) it is advantageous to change the blade setting. In a turbocharger which is embodied as a waste gate charger with a variable waste gate opening it is advantageous to change the waste gate opening.

As a further measure it is possible to provide for the quantity of exhaust gas which is recirculated to be changed in order to increase the temperature of the exhaust gas. For example, an adjustable exhaust gas recirculation valve is provided for this purpose, said valve being actuated correspondingly by the engine controller. The exhaust gas recirculation valve is preferably opened wider. This permits both the temperature of the exhaust gas and the oxygen content of the exhaust gas to be influenced.

As a further measure it is possible to provide for the fuel injection parameters to be changed. This measure allows the input of heat into the exhaust gas leaning unit to be additionally increased. It may be advantageous in this context to change the time, the quantity and/or the pressure of a fuel injection compared to the normal operating mode. In particular, it may be expedient to shift the start of a main fuel injection process. It is also advantageous to carry out postinjection. This may be carried out, if appropriate, in such a way that unburnt fuel components are fed to the exhaust gas cleaning unit. In this way, catalytic post-combustion can very effectively increase the temperature of the exhaust gas. In addition, the content of free oxygen in the exhaust gas can, if appropriate, be decreased as far as a reducing exhaust gas composition. In addition, by means of the content of the free oxygen in the exhaust gas it is possible to influence the speed at which soot is burnt off, thus preventing excessive release of heat in the particle filter when soot is burnt off.

In particular in a motor vehicle having preheating of the intake air, it is possible to provide as a further measure that said preheating function is switched on in a regeneration operating mode. In particular it is advantageous to switch on an electric heater in the intake section of the internal combustion engine B. On the one hand, the additional power demand causes the power which is output by the internal combustion engine B to be increased, and on the other hand the heated intake air directly brings about a rise in the temperature of the exhaust gas.

It is advantageous if the aforesaid measures are assigned to predefined characteristic diagram ranges in the load/rotational speed characteristic diagram of the internal combustion engine, and the assignment can be stored in the engine control device. A partial load range is preferable in the characteristic diagram for this purpose. It is likewise advantageous to take the aforesaid measures as a function of the temperature of the exhaust gas and/or the exhaust gas cleaning unit or as a function of the difference between these temperatures and predefined temperature setpoint values, for which purpose, for example, an assignment table can be provided.

The measures according to the invention make it possible, if appropriate, to perform regeneration of a particle filter when the vehicle is stationary. This is particularly advantageous if, owing to persistently poor regeneration conditions in the driving mode, no regeneration, or insufficient regeneration, can be carried out. In this case, it is possible, for example at the instigation of an on-board diagnosis, to request that the internal combustion engine be operated with the explained measures according to the invention in a regeneration operating mode in breaks in driving. It is expedient here to take the measures according to the invention at an increased idling speed.

The invention claimed is:

1. A multi-cylinder internal combustion engine for a motor vehicle, comprising:

an exhaust line which is assigned to cylinders of the internal combustion engine, an exhaust gas cleaning unit arranged in the exhaust line, a gas inlet valve which is used for a charge cycle and which is adapted to let combustion air into a combustion chamber assigned to each of the cylinders, a gas outlet valve which is used for the charge cycle and which is adapted to let exhaust gases out of the combustion chamber and into the exhaust line assigned to each of the cylinders, and an additional outlet valve through which, in an opened state, a flow connection is established between the respective combustion chamber and the exhaust line provided for at least one of the cylinders of the internal combustion engine, wherein the additional outlet valve of the at least one cylinder can be activated in conjunction with a regeneration operating mode for regenerating the exhaust gas cleaning unit, and wherein when the additional outlet valve is activated via the flow connection which is established by the additional outlet valve, gas passes out of the combustion chamber of the at least one of the cylinders and into the exhaust line and, as a result, can change at least one of an exhaust gas composition and an exhaust gas temperature compared to a normal operating mode so as to set the at least one of the composition and temperature to promote regeneration of the exhaust gas cleaning unit.

2. The internal combustion engine as claimed in claim 1, wherein, when the additional outlet valve is activated, at least one cylinder can be operated with a fuel supply which is reduced compared to the operating mode without activation of the additional outlet valve.

3. The internal combustion engine as claimed in claim 1, wherein, when there is at least one cylinder with an additional outlet valve, the additional outlet valve can be activated in a clocked fashion such that, when there are a multiplicity of working cycles, the additional outlet valve is opened in each case in a region of top dead center in the compression cycle and is otherwise closed.

4. The internal combustion engine as claimed in claim 1, wherein a cylinder group is formed from at least two of the cylinders and an additional outlet valve.

5. The internal combustion engine as claimed in claim 1, wherein when there are at least two cylinders and an additional outlet valve, the additional outlet valve can be activated.

6. The internal combustion engine as claimed in claim 1, wherein each of at least two cylinders is provided with an additional outlet valve, and wherein the number of cylinders at which the additional outlet valve is activated can be set in a variable fashion as a function of the exhaust gas temperature.

7. The internal combustion engine as claimed in claim 1, wherein operation with the additional outlet valve closed and with a fuel supply which is reduced compared to the normal operating mode becomes possible.

8. The internal combustion engine as claimed in claim 1, wherein the regeneration operating mode can be set when the additional outlet valve of the at least one cylinder is activated in an operating range with reduced power output by the internal combustion engine.

9. The internal combustion engine as claimed in claim 1, wherein a charge pressure of an exhaust gas turbocharger can be influenced in conjunction with a regeneration operating mode.

10. The internal combustion engine as claimed in claim 1, wherein a quantity of exhaust gas recirculated by an adjustable exhaust gas recirculation device can be influenced in conjunction with a regeneration operating mode.

11. The internal combustion engine as claimed in claim 10, wherein the regeneration operating mode is provided when the vehicle is stationary.

12. A method for operating a multi-cylinder internal combustion engine for a motor vehicle, having an exhaust line which is assigned to cylinders of the internal combustion engine, an exhaust gas cleaning unit arranged in the exhaust line, a gas inlet valve which is used for a charge cycle and which is adapted to let combustion air into the combustion chamber of the cylinder, a gas outlet valve which is used for the charge cycle and which is adapted to let exhaust gases out of the combustion chamber and into the exhaust line, and an additional outlet valve, through which, in an opened state, a flow connection is established between the combustion chamber and the exhaust line, provided for at least one of the cylinders of the internal combustion engine, comprising:

opening the additional outlet valve of the at least one of the cylinders at least temporarily in conjunction with a regeneration operating mode for regenerating the exhaust gas cleaning unit so that, via the connection which is opened by the additional outlet valve, gas passes out of the combustion chamber of the at least one cylinder and into the exhaust line, and changing at least one of an exhaust gas composition and an exhaust gas temperature compared to a normal operating mode as a result so as to set the at least one of the composition and temperature to promote the regeneration of the exhaust gas cleaning unit.

13. The method as claimed in claim 12, wherein at least one of the cylinders is operated with an at least temporarily opened additional outlet valve and with a fuel supply which is reduced compared to the normal operating mode.

14. The method as claimed in claim 12, wherein the additional outlet valve of at least one cylinder is kept open in a region of top dead center in the compression stroke, and otherwise kept closed, during a multiplicity of working cycles.

15. The method as claimed in claim 12, wherein the additional outlet valve of at least one cylinder is kept continuously open during a multiplicity of working cycles of the cylinder.

16. The method as claimed in claim 12, wherein at least one cylinder of the internal combustion engine is operated with a fuel supply which is reduced compared to the normal operating mode.

17. The method as claimed in claim 12, wherein at least two preferably adjacent cylinders are provided with an additional outlet valve and their additional outlet valves are activated synchronously.

18. The method as claimed in claim 12, wherein at least two cylinders are provided with an additional outlet valve, and the number of cylinders with an at least temporarily opened additional outlet valve is set as a function of the load of the internal combustion engine.

19. The method as claimed in claim 12, wherein a reduced charge pressure of an exhaust gas turbocharger is set in conjunction with the regeneration operating mode.

20. The method as claimed in claim 12, wherein an increased quantity of exhaust gas recirculated by an adjustable exhaust gas recirculation device is set in conjunction with the regeneration operating mode.

21. The method as claimed in claim 12, wherein the regeneration operating mode is carried out when the vehicle is stationary.

* * * * *